US005714115A

United States Patent [19]

Speidel et al.

[11] Patent Number: 5,714,115

[45] Date of Patent: Feb. 3, 1998

[54] AUSTENITIC STEEL ALLOY

[75] Inventors: Markus O. Speidel, Birmenstorf; Peter J. Uggowitzer, Ottenbach, both of Switzerland; Gerald Stein, Essen; Joachim Menzel, Weldenbruch, both of Germany

[73] Assignee: VSG Energie-und Schmiedetechnik GmbH, Essen, Germany

[21] Appl. No.: 622,982

[22] Filed: Mar. 27, 1996

[30] Foreign Application Priority Data

Apr. 8, 1995 [DE] Germany ..... 195 13 407.9

[51] Int. Cl.[6] ..... C22C 38/38; C21D 9/00

[52] U.S. Cl. ..... 420/65; 420/67; 420/68; 420/69; 148/610; 148/325

[58] Field of Search ..... 420/65, 67, 68, 420/69; 148/610, 325

[56] References Cited

U.S. PATENT DOCUMENTS 3,366,472 1/1968 Tanczyn et al. ..... 420/66

FOREIGN PATENT DOCUMENTS 778597 7/1957 United Kingdom ..... 420/66

*Primary Examiner*—Deborah Yee

*Attorney, Agent, or Firm*—Meltzer, Lippe, Goldstein, Wolf & Schlissel, P.C.

[57] ABSTRACT

The invention relates to an austenitic steel alloy which is corrosion-resistant, tough, non-magnetic and compatible with the skin. The invention also relates to a process for the production of said steel alloy and to uses thereof. The characterizing feature of the invention is a steel containing up to 0.3% C, 2 to 26% Mn, 11 to 24% Cr, more than 2.5 to 10% Mo, 0 to 8% W, more than 0.55 to 1.2% N, up to max 0.5% Ni and max 2 % Si, balance iron.

20 Claims, No Drawings

AUSTENITIC STEEL ALLOY

The invention relates to an austenitic steel alloy which is corrosion-resistant, tough, non-magnetic and compatible with the skin. The invention also relates to a process for the production of said steel alloy and to uses thereof.

Known stainless steels, for example, the type 18/10 CrNi can cause a nickel allergy in contact with the human body. European countries have therefore already passed legislation prohibiting the use of nickel-containing materials on or in the human body. Gold alloys and titanium alloys are indicated substitutes, but they are expensive and laborious to produce.

As a rule, materials which are used on and in the human body must satisfy a whole series of demands: they must have high strength and toughness, must be non-ferromagnetic (antimagnetic), resistant to wear and corrosion and inexpensive. The alloy according to the invention meets these conditions.

It is an object of the invention to provide an alloy which contains no nickel and is at the same time much cheaper and more readily available than gold and its alloys.

This problem is solved according to the invention by an austenitic alloy having the following composition in % by weight:

up to 0.3% C
2 to 26% Mn
11 to 24% Cr
more than 2.5 to 10% Mo
0 to 8% W
more than 0.55 to 1.2% N
residue iron and unavoidable impurities, including up to max 0.5% Ni and max 2% Si.

The steel alloy according to the invention solves the problem stated, since it is corrosion-resistant, tough, non-magnetic and free from or low in nickel and is therefore compatible with the skin.

The effects of the individual elements of the alloy according to the invention are as follows:

Carbon (C)

In solid solution, carbon increases the nickel equivalent and can therefore stabilize the austenite structure. However, even slightly increased carbon contents lead to an adverse effect on resistance to corrosion or stress corrosion cracking and increase the tendency to precipitate formation. The carbon content should therefore be lower than 0.3%, preferably lower than 0.1%.

Silicon (Si)

The alloys according to the invention can be produced by the pressure electroslag remelting (PESR) process, the nitrogen content being increased by the addition of silicon nitride. However, silicon encourages the formation of ferromagnetic delta ferrite. The content of silicon as an impurity should therefore be less than 2%, preferably less than 1%.

Manganese (Mn)

Manganese suppresses the formation of delta ferrite and increases nitrogen solubility, thereby suppressing the formation of nitrogenous precipitations. Manganese should therefore be kept to a value of at least 2%. However, excessive manganese contents encourage the formation of intermetallic phases and cause corrosion behaviour to deteriorate. For this reason the manganese content should not exceed 26%, being preferably between 6% and 20%.

Chromium (Cr)

Chromium is a decisive element for increasing resistance to corrosion. To achieve an adequate effect, the chromium content should be at least 11%. However, an excessive chromium content leads to the formation of delta ferrite and increases the tendency towards the precipitation of sigma phase. The chromium content should therefore be between 11 and 24%, preferably between 11% and 20%.

Molybdenum (Mo)

Along with chromium, molybdenum is the second decisive element for increasing resistance to corrosion. To achieve an adequate effect, the molybdenum content should be higher than 2.5%. However, an excessive molybdenum content leads to the formation of delta ferrite and increases the tendency towards the separation of sigma phase. The molybdenum content should therefore be limited to 10%, preferably 6%.

Tungsten (W)

Similarly to molybdenum, tungsten increases resistance to corrosion, but excessive contents thereof encourage the formation of delta ferrite and increase the tendency towards the precipitation of sigma phase. The tungsten content should therefore be up to 8%, preferably up to 6%.

Nitrogen (N)

Nitrogen is a decisive alloying element in a number of respects. It increases to a considerable extent the stability of austenite, thereby ensuring the austenitic crystalline structure. However, nitrogen also increases resistance to corrosion. For this reason the N content should be higher than 0.55%. However, excessive nitrogen contents lead to a massive loss of toughness, so that a content of 1.2% should not be exceeded. Preferably a nitrogen content of 0.7% to 1.1% should be adjusted.

Nickel (Ni)

The alloy is deliberately free from added nickel. With an upper limit of 0.5% Ni as an impurity the alloy allows, for example, for Austrian Order N 592 of 26 Aug. 1993 and European Directive No. C116/18 of 27 Apr. 1993, both of which require that a) of an alloy used on and in the human body not more than 0.05 mg nickel per $cm^2$.week should pass into solution, and that b) small rods used for the piercing of ears and for pierced ears must not contain more than 0.05% nickel.

The requirement under point a) is in any case met by the alloy according to the invention, even if normal steel scrap is used for melting. Alloys which meet point b) must be produced using a special Ni-low preliminary material (Ni<0.05%) and are therefore correspondingly more expensive.

The alloy is very particularly resistant to corrosion, due to its high content of molybdenum, tungsten, nitrogen and chromium. It therefore dissolves to an extremely small extent in body fluids and in human perspiration and gives off extremely few ions to the human body. Resistance to corrosion in chloride solutions increases with the active total % Cr+3.3 (% Mo+% W)+20 (% N). Ordinary stainless steels, which are used a great deal nowadays for jewellery, utility articles worn on the body and medical apparatuses, have an active total of typically 18 to 25. In contrast, the alloy according to the invention has an active total of over 25—i.e., it is distinctly more resistant to corrosion. The alloy is non-magnetic. This is ensured if the nickel equivalent 1) is equal to or greater than the chromium equivalent 2) minus 8. This ensures that the alloy contains sufficient elements, such as manganese and nitrogen, which stabilize the cubic face-centered ("austenitic") crystal lattice. The result is that the ferromagnetic ferrite phase is not formed.

The alloy is tough. This is ensured according to the invention by the feature that the nitrogen content in solid solution is kept lower than 1.2% (nickel equivalent lower than 25 or 20), since higher nitrogen contents might lead to brittle cleavage fracture even at room temperature. The nitrogen together with 1) nickel equivalent:

$$Ni_e = Ni + Co + 0.1\ Mn - 0.01\ Mn^2 + 18\ N + 30C$$

2) chromium equivalent:

$$Cr_e = Cr + 1.5\ Mo + 1.5\ W + 0.48\ Si + 2.3\ V + 1.75\ Nb + 2.5\ Al$$

the manganese stabilizes the tough cubic face-centered crystal lattice. At the same time the nitrogen and manganese content make the alloy resistant to abrasion and therefore wear. The toughness of the alloy is particularly high if a preferably homogeneous austenitic structure is created by solution annealing and quenching.

The alloy can be adapted to special conditions by small additions. Very small additions of sulphur can make the alloy more readily machineable, if the main emphasis is on workability rather than resistance to corrosion. The alloy can be made more readily machineable and easier to polish by small additions of bismuth. The cubic face-centered phase and therefore freedom from ferromagnetism can be stabilized by copper and/or cobalt. The strength and resistance to fatigue of the alloy can be increased by small vanadium-containing or niobium-containing precipitations, but also by the formation of precipitations by the elements titanium, zirconium, hafnium, tantalum, aluminium or boron.

The applications of the alloy according to the invention are more particularly uses on and in the human body, where nickel allergy is to be prevented. This includes both jewellery (earrings, rings) and also fashion articles (belt buckles, buttons), spectacles and watches and all metallic articles which are worn, even only briefly, on or in the body. The applications according to the invention also include all medical apparatuses, devices, implants, for example, teeth braces, fillings and filling materials, orthodontic devices, such as wires, screws, etc., and also metal attachments and fixings in the body, for example, spiking wires, bone nails and temporarily, permanently or partially incorporated plates and screws for the healing of bone fractures, such as needles, syringes, acupuncture needles, surgical and ophthalmological equipment—i.e., all either permanent or temporary applications on and in the human body, quite in general. The use of the alloy according to the invention also includes such structural members and apparatuses which might trigger a nickel allergy by being employed close to the human body. This applies to spectacle frames or parts thereof, zip fasteners, rivets on jeans and belt fittings, cigarette lighters, hospital equipment, beds, railings, cutlery vessels and in general constructional members which often come into contact with the human body or its fluids.

The strength of the steel alloy according to the invention can be distinctly improved by cold forming following solution annealing and quenching.

The invention will now be described in greater detail from the following examples.

EXAMPLE 1

An alloy having the chemical composition 17.5% Cr, 4% Mo, 11% Mn, 0.02% C, 0.88% N and 0.01% Ni, residue Fe, was melted in a pressure electroslag remelting plant and then forged. After a solution annealing at 1150° C. the alloy was homogeneously austenitic and free from precipitations and delta ferrite - i.e., completely non-magnetic.

This alloy has a high active total % Cr+3.3(% Mo)+20(% N) of 48.3.

The Ni equivalent is 18.8 and the Cr equivalent=24. The Ni equivalent is therefore under 20 and the Cr equivalent is lower than the Ni equivalent by less than 8.

The properties of the alloy following solution annealing at 1150° C. and quenching in water:

| | |
|---|---|
| structure: | fully austenitic, non-magnetic |
| hardness: | 320 HRB |
| strength: | yield point 640 MPa, tensile strength 1080 MPa, elongation after fracture 63% |
| toughness: | notched bar impact work approx. 300 J |
| resistance to wear: | 3 times better than a nickel austenite of type 18/8 |
| resistance to corrosion: | comparable to the resistance of "superaustenites", e.g., at least as good as X3CrNiMnMoN 23 17 5 3 (1.4565) or X3NiCrMoN 24 20 6 (Al-6XN), distinctly better than X3CrNiMo 17 11 3 (AISI 316) or X3NiCrMo 25 20 4 (904L) |

The properties of the alloy change after 40% cold forming (swaging) as follows:

| | |
|---|---|
| hardness: | 540 HRB |
| strength: | yisld point 1610 MPa, tensile strength 1650 MPa, elongation after fracture 15% |
| toughness: | notched bar impact work approx. 60 J |

EXAMPLE 2

An alloy having the chemical composition 14% Cr, 6% Mo, 12% Mn, 0.9% N was melted in a pressure induction furnace and then forged. The alloy had a high active total % Cr+3.3(% Mo)+20(% N) of 51.8.

The Ni equivalent was 13.6 and the Cr equivalent=21.

Properties of the alloy after solution annealing at 1200° C. and quenching in water.

| | |
|---|---|
| structure: | fully austenitic, non-magnetic |
| hardness: | 320 HRB |
| strength: | yield point 640 MPa, tensile strength 1050 MPa, elongation after fracture 64% |
| toughness: | notched bar impact work approx. 250 J |
| resistance to wear: | 3 times better than a nickel austenite of type 18/8 |
| resistance to corrosion: | comparable to the resistance of "superaustenites", e.g., at least as good as X3CrNiMnMoN 23 17 5 3 (1.4565) or X3NiCrMoN 24 20 6 (Al—6XN), distinctly better than X3CrNiMo 17 11 3 (AISI 316) or X3NiCrMo 25 20 4 (904L) |

We claim:

1. A steel alloy having the following composition (in % by weight):

up to 0.1% C 6 to 20% Mn 11 to 20% Cr more than 2.5 to 6% Mo 0 to 6%

0.7 to 1.1% N residue iron and unavoidable impurities, including up to max 0.2% Ni and up to max 1.0% Si, wherein the active total % Cr+3.3 (% Mo+% W)+20 (%

N) is at least 35 and the nickel equivalent is lower than 20, but equal to or greater than the chromium equivalent minus 8.

2. A steel alloy according to claim 1 which additionally contains up to 0.2% S.

3. A steel alloy according to claim 1 which additionally contains up to 5% Bi.

4. A steel alloy according to claim 1 which additionally contains up to 5% Cu and/or Co.

5. A steel alloy according to claim 1 which additionally contains up to a total 1.0% of V, Nb, Ti, Zr, Hf, Ta, and/or Al.

6. A steel alloy according to claim 1 which additionally contains up to 0.02% B.

7. A process for the production of a steel alloy according to claim 1 which comprises subjecting the composition of claim 1 to a solution annealing treatment followed by quenching.

8. A process according to claim 7 which comprises, after solution annealing and quenching, cold working said steel alloy to increase its strength.

9. An article which comes into contact with a human body during normal use, said article being made from an austenitic steel alloy, wherein said steel alloy has the following composition (in % by weight):

up to 0.1% C 6 to 20% Mn 11 to 20% Cr more than 2.5 to 6% Mo 0 to 6% W 0.7 to 1.1% N residue iron and unavoidable impurities, including up to max 0.2% Ni and up to max 1.0% Si, wherein the active total % Cr+3.3 (% Mo+% W)+20 (% N) is at least 35 and the nickel equivalent is lower than 20, but equal to or greater than the chromium equivalent minus 8.

10. The article of claim 9 wherein said steel alloy additionally contains up to 0.2% S.

11. The article of claim 9 wherein said steel alloy additionally contains up to 5% Bi.

12. The article of claim 9 wherein said steel alloy additionally contains up to 5% Cu and/or Co.

13. The article of claim 9 wherein said steel alloy additionally contains up to a total 1.0% of V, Nb, Ti, Zr, Hf, Ta, and/or Al.

14. The article of claim 9 wherein said steel alloy additionally contains up to 0.02% B.

15. A process for the production of the steel alloy of claim 9 which comprises subjecting the composition of claim 9 to a solution annealing treatment followed by quenching.

16. A process according to claim 15 which comprises after solution annealing and quenching, cold working said steel alloy to increase its strength.

17. The article of claim 9 which is designed to be worn on, in, or close to the human body.

18. The article of claim 17 which is an article of jewelry.

19. The article of claim 17 which comprises an implant in the human body.

20. The article of claim 17 which is designed for dental use.

* * * * *